US011053576B2

(12) United States Patent
Yamamoto et al.

(10) Patent No.: US 11,053,576 B2
(45) Date of Patent: Jul. 6, 2021

(54) METHOD FOR PRODUCING ALUMINUM ALLOY ROLLED MATERIAL FOR MOLDING HAVING EXCELLENT BENDING WORKABILITY AND RIDGING RESISTANCE

(71) Applicant: UACJ CORPORATION, Tokyo (JP)

(72) Inventors: Yusuke Yamamoto, Tokyo (JP); Yoshifumi Shinzato, Tokyo (JP); Mineo Asano, Tokyo (JP)

(73) Assignee: UACJ Corporation, Tokyo (JP)

( * ) Notice: Subject to any disclaimer, the term of this patent is extended or adjusted under 35 U.S.C. 154(b) by 0 days.

(21) Appl. No.: 15/558,089

(22) PCT Filed: Jul. 12, 2017

(86) PCT No.: PCT/JP2017/025401
§ 371 (c)(1),
(2) Date: Sep. 13, 2017

(87) PCT Pub. No.: WO2018/012532
PCT Pub. Date: Jan. 18, 2018

(65) Prior Publication Data

US 2019/0119800 A1 Apr. 25, 2019

(30) Foreign Application Priority Data

Jul. 14, 2016 (JP) ..... JP2016-139812
Feb. 14, 2017 (JP) ..... JP2017-025445

(51) Int. Cl.
*C22F 1/05* (2006.01)
*C22F 1/057* (2006.01)
(Continued)

(52) U.S. Cl.
CPC ..... *C22F 1/05* (2013.01); *B21B 3/00* (2013.01); *C22C 21/02* (2013.01); *C22C 21/08* (2013.01);
(Continued)

(58) Field of Classification Search
None
See application file for complete search history.

(56) References Cited

U.S. PATENT DOCUMENTS

2002/0005232 A1* 1/2002 Matsuda ..... C22C 21/14 148/417
2004/0094249 A1* 5/2004 Uchida ..... C22C 21/08 148/693
(Continued)

FOREIGN PATENT DOCUMENTS

JP 7-228956 8/1995
JP 2823797 9/1998
(Continued)

OTHER PUBLICATIONS

English Translation of JP 2010-242215 A, Espacenet (Year: 2019).*
(Continued)

*Primary Examiner* — Stefanie J Cohen
*Assistant Examiner* — Christopher D. Moody
(74) *Attorney, Agent, or Firm* — Greer Burns & Crain Ltd.

(57) ABSTRACT

The present disclosure relates to a method for producing an aluminum alloy rolled material for deformation molding, the method including: a step of performing homogenization treatment of an ingot including an aluminum alloy with predetermined composition; a step of cooling the aluminum alloy after the homogenization treatment so that an average cooling rate in an ingot thickness of ¼ part from 500° C. to 320° C. is 30° C./h to 2000° C./h; and a step of starting hot
(Continued)

rolling at 370° C. to 440° C. and winding the hot-rolled aluminum alloy at 310 to 380° C., in which the method for producing an aluminum alloy rolled material for deformation molding further includes a step of retaining the aluminum alloy after the cooling step for 0.17 hours or more at a heating temperature before rolling set within a range of 370° C. to 440° C. before the hot rolling.

8 Claims, 2 Drawing Sheets

(51) Int. Cl.

| | |
|---|---|
| ***C22C 21/02*** | (2006.01) |
| ***C22C 21/08*** | (2006.01) |
| ***B21B 3/00*** | (2006.01) |
| ***C22C 21/14*** | (2006.01) |
| ***C22C 21/16*** | (2006.01) |
| ***C22C 21/18*** | (2006.01) |

(52) U.S. Cl.
CPC ..... *C22C 21/14* (2013.01); *C22C 21/16* (2013.01); *C22C 21/18* (2013.01); *C22F 1/057* (2013.01); *B21B 2003/001* (2013.01)

(56) References Cited

U.S. PATENT DOCUMENTS

| | | | | |
|---|---|---|---|---|
| 2007/0209739 | A1* | 9/2007 | Zhao | C22C 21/08 148/551 |
| 2008/0175747 | A1* | 7/2008 | Kajihara | C22C 21/06 420/532 |
| 2009/0081072 | A1* | 3/2009 | Zhao | C22C 21/02 420/535 |
| 2011/0017370 | A1* | 1/2011 | Takaki | C22C 21/08 148/692 |
| 2012/0291924 | A1* | 11/2012 | Zhao | C22F 1/05 148/551 |
| 2013/0164170 | A1* | 6/2013 | Nakai | C22F 1/00 420/532 |
| 2014/0166162 | A1* | 6/2014 | Hirayama | C22C 21/06 148/551 |
| 2015/0007909 | A1* | 1/2015 | Matsumoto | C22F 1/00 148/418 |
| 2015/0354044 | A1* | 12/2015 | Shishido | C22C 21/08 420/534 |
| 2015/0368761 | A1* | 12/2015 | Shishido | C22F 1/05 420/530 |
| 2016/0201168 | A1* | 7/2016 | Shishido | C22F 1/043 148/439 |
| 2020/0340091 | A1* | 10/2020 | Boissonnet | B21B 3/00 |

FOREIGN PATENT DOCUMENTS

| | | | | | |
|---|---|---|---|---|---|
| JP | 2001342577 | A | | 12/2001 | |
| JP | 2002146462 | A | | 5/2002 | |
| JP | 2003-226926 | A | | 8/2003 | |
| JP | 2003-277870 | A | | 10/2003 | |
| JP | 2004-010982 | A | | 1/2004 | |
| JP | 2004-124213 | A | | 4/2004 | |
| JP | 3590685 | | | 8/2004 | |
| JP | 2006-241548 | A | | 9/2006 | |
| JP | 2008-045192 | A | | 2/2008 | |
| JP | 2008045192 | A | * | 2/2008 | C22F 1/05 |
| JP | 2009-263781 | A | | 11/2009 | |
| JP | 2010-242215 | A | | 10/2010 | |
| JP | 2010242215 | A | * | 10/2010 | C22F 1/05 |
| JP | 2012-077318 | A | | 4/2012 | |
| JP | 2012-077319 | A | | 4/2012 | |
| JP | 2012-214846 | A | | 11/2012 | |
| JP | 2014-152381 | A | | 8/2014 | |
| JP | 2015-067857 | A | | 4/2015 | |
| KR | 20090104739 | A | | 10/2009 | |
| WO | 2009123011 | A1 | | 10/2009 | |

OTHER PUBLICATIONS

English Translation of JP 2008-045192, JPlatPat (Year: 2020).*
Korean office action issued by KIPO dated Mar. 20, 2018 (with translation).
Written opinion of the Int'l. Searching Authority issued in Int'l. App. No. PCT/JP2017/025401, dated Nov. 13, 2017.
Japanese office action issued in Japanese Patent App. No. 2017-025445, dated Apr. 18, 2017 (with translation).

* cited by examiner

METHOD FOR PRODUCING ALUMINUM ALLOY ROLLED MATERIAL FOR MOLDING HAVING EXCELLENT BENDING WORKABILITY AND RIDGING RESISTANCE

This is a National Phase Application filed under 35 U.S.C. § 371, of International Application No. PCT/JP2017/025041, filed Jul. 12, 2017.

TECHNICAL FIELD

The present disclosure relates to a method for producing a rolled material for molding comprising an aluminum alloy, which is subjected to molding and coating baking and is used as the members and components of various automobiles, ships, aircraft, and the like, such as automobile body sheets and body panels, construction materials, structural materials, and materials for various machinery and appliances, household electrical appliances, the components thereof, and the like. In particular, the present disclosure relates to a method for producing an aluminum alloy rolled material for molding which is preferred for the applications and is excellent in bending workability and ridging resistance.

BACKGROUND ART

Demands for improvement in fuel efficiency through a reduction in the weights of automobiles have been increased against recent requirements such as suppression of global warming and a reduction in energy costs as backgrounds. In response to the demands, aluminum alloy sheets have also increasingly tended to be used as automotive body sheets applied to automobile body panels, in place of conventional cold rolled steel sheets. An aluminum alloy sheet has a specific gravity about one-third the specific gravity of a conventional cold rolled steel sheet while having a strength approximately equivalent to the strength of the conventional cold rolled steel sheet, and can contribute to a reduction in the weight of an automobile. Aluminum alloy sheets have also been recently often used in molded components such as the panels and chassis of electronic and electrical instruments and the like, in addition to automotive applications. Like automotive body sheets, such aluminum alloy sheets have been often pressed and used.

The workability of the sheet materials for molding has been more strictly required because the design properties of the shapes of automobiles and the like have been highly required in recent years. The automotive body panels have been often used after hemming of the edges of sheets in order to join and integrate outer and inner panels. The hemming can be considered to be very severe working for a material because 180° bending is performed at an extremely small bend radius. Thus, excellent hemming workability and bending workability in consideration of such applications are required.

As described above, more severe molding of aluminum alloy sheets for molding has been particularly recently often performed. In addition to severe molding conditions, importance has been placed on surface appearance quality. With regard to the surface appearance quality, it is strongly demanded that not only no Lueders mark is generated but also no ridging mark is generated even when the severe molding described above is performed.

The ridging mark is a fine recessed and projected pattern that appears in a stripe shape in a direction parallel to the direction of rolling in a step of producing a sheet when molding of the sheet is performed. Surface appearance quality may be deteriorated because a site at which such a ridging mark is generated appears as, for example, a site with less luster or the like even after a sheet surface is coated. Therefore, a material for an automobile body sheet or the like particularly requiring high surface appearance quality strongly requires that a ridging mark is prevented from being generated in molding. Hereinafter, in this specification, resistance to generation of a ridging mark in molding is referred to as "ridging resistance."

Examples of known aluminum alloys for molding commonly used for automotive body sheets include 5000 series aluminum alloys (Al—Mg-based alloys) and 6000 series aluminum alloys (Al—Mg—Si-based alloys, Al—Mg—Si—Cu-based alloys, and the like) with aging properties. In particular, the 6000 series aluminum alloys have relatively low strength and excellent moldability in molding prior to coating baking, has an advantage in that the 6000 series aluminum alloys are aged by heating during coating baking, thereby enhancing the strength of the 6000 series aluminum alloys after the coating baking, and has an advantage in that, for example, generation of a Lueders mark is inhibited.

As described above, aluminum alloy sheet materials for molding have required more severe working conditions for bending workability. Not only securing of bending workability but also ridging resistance for improving surface appearance quality has been demanded. Various commitments have also been made to the aluminum alloy sheet materials described above.

It has been pointed out that the bending workability of an aluminum alloy sheet material is profoundly associated with the particle sizes of Al—Fe—Si-based particles, Mg—Si-based particles, or the like which are precipitates in an alloy, and the texture of the alloy. For example, in Patent Literature 1 to 4, proposals are made from the viewpoints of the control of the sizes of particles and the dispersion state of the particles, and the control of a texture and an r-value caused by the texture.

In parallel with such proposals for improvement of workability as described above, some commitments to improvement of ridging resistance associated with appearance quality after working have been reported. According to the commitments, generation of a ridging mark has been confirmed to be profoundly associated with a recrystallization behavior in a material. In addition, it has been proposed as a manner for inhibiting the generation of a ridging mark that recrystallization is controlled in a process for producing a sheet by hot rolling and/or the like performed after homogenization treatment of an alloy ingot.

As such a specific manner for improving ridging resistance, for example, a temperature at which hot rolling is started is principally set at a relatively low temperature of 450° C. or less, thereby inhibiting crystal grains from coarsening during hot rolling and then controlling a material structure after cold working and solution treatment, in Patent Literature 5 and 6. Patent Literature 9 mentions differential speed rolling in a warm region and differential speed rolling in a cold region after hot rolling. In Patent Literature 6, 7, and 8, it is proposed that intermediate annealing is performed after hot rolling, or that cold rolling is temporarily performed, followed by performing intermediate annealing.

In Patent Literature 8 and 9, it is proposed that self-annealing is performed by heat in winding of a rolled sheet that has been hot-rolled, thereby temporarily decomposing a stripe-shaped structure caused by ingot crystal grains. It is considered that a sheet material with favorable ridging resistance can be produced because the stripe-shaped structure is sufficiently decomposed when recrystallization is re-performed in solution treatment.

Patent Literature 10 describes that an alloy ingot is subjected to homogenization treatment and then to hot rolling into a rolled material having a thickness of 4 to 20 mm, and the rolled material is cold-rolled to have a sheet thickness of 2 mm or more at a sheet thickness reduction rate of 20% or more, thereby forming a sheet material with an appropriate cube orientation.

CITATION LIST

Patent Literature

Patent Literature 1: Unexamined Japanese Patent Application Kokai Publication No. 2012-77319

Patent Literature 2: Unexamined Japanese Patent Application Kokai Publication No. 2006-241548

Patent Literature 3: Unexamined Japanese Patent Application Kokai Publication No. 2004-10982

Patent Literature 4: Unexamined Japanese Patent Application Kokai Publication No. 2003-226926

Patent Literature 5: Japanese Patent No. 2823797

Patent Literature 6: Japanese Patent No. 3590685

Patent Literature 7: Unexamined Japanese Patent Application Kokai Publication No. 2012-77318

Patent Literature 8: Unexamined Japanese Patent Application Kokai Publication No. 2010-242215

Patent Literature 9: Unexamined Japanese Patent Application Kokai Publication No. 2009-263781

Patent Literature 10: Unexamined Japanese Patent Application Kokai Publication No. 2015-67857

SUMMARY OF INVENTION

Technical Problem

Individual characteristics of bending workability and ridging resistance have been confirmed to be improved in the techniques for improving the conventional production processes described above and aluminum alloy sheet materials for molding produced by the techniques. However, compatibility between both the bending workability and the ridging resistance is needed for addressing more severe requirements of improvement in molding characteristics and surface quality in recent years but achieving this compatibility is not easy. This is because the manners for improving bending workability and ridging resistance described in Patent Literature 1 to 6 are not intrinsically designed for compatibility with other characteristics.

With regard to production processes, it is also possible that the effect of the setting of a temperature at which hot rolling is started at a relatively low temperature in Patent Literature 5 and 6 is not always sufficient when molding conditions become more severe. Sometimes, the intermediate annealing after hot rolling performed in Patent Literature 6, 7, and 8 and the differential speed rolling in Patent Literature 7 exhibit no effect of improving ridging resistance. With regard to the performance of self-annealing by heat in winding in hot rolling proposed in Patent Literature 8 and 9, a precipitate, which is not taken into consideration in either literature, may prevent recrystallization, thereby precluding the self-annealing. According to the present inventors, such definition of a sheet thickness and the like after hot rolling as described in Patent Literature 10 proves not to be a perfect manner for improving both bending workability and ridging resistance.

Thus, the present disclosure is to provide a method for producing an aluminum alloy sheet material for molding that can secure surface quality after working while addressing severe molding conditions and that achieves mutual compatibility between bending workability and ridging resistance.

Solution to Problem

As shown in the conventional technologies described above, the presence of a stripe-shaped structure caused by ingot crystal grains in an aluminum alloy has been mentioned as one of causes of the generation of a ridging mark incident to molding such as bending (hemming). It has been proposed to decompose the stripe-shaped structure by recrystallization as a method for improving ridging resistance. In the examination by the present inventors, it is also recognized that the control of a material structure by recrystallization that occurs in a process for producing an aluminum alloy sheet, particularly in a hot rolling step, can function for improving ridging resistance.

The present inventors arrived at the control of the particle diameters of Mg—Si-based particles which are precipitates that can be generated after homogenization treatment of an ingot of an aluminum alloy, as a method for allowing recrystallization to effectively proceed in a process for producing an aluminum alloy sheet. The Mg—Si-based particles have been confirmed to be precipitated in a cooling process after homogenization treatment. The Mg—Si-based particles may also be precipitated in a heating process in the case of cooling an ingot after homogenization treatment to around room temperature in a cooling process and then heating the ingot to a hot-rolling temperature for hot rolling. The composition of the Mg—Si-based particles precipitated in the processes is influenced by Cu addition. In this case, the Mg—Si-based particles become Mg—Si—Cu-based particles. However, the Mg—Si-based particles have been found to have the morphology of fine precipitates regardless of the composition of the Mg—Si-based particles.

Even if hot rolling is performed in an unaddressed state in which fine precipitates including Mg—Si-based particles are dispersed, the fine precipitates are inhibited from functioning as the origin of a recrystallized structure and rather become a cause of suppressing recrystallization. Therefore, a state in which hot rolling does not cause an expected recrystallized structure or in which even if recrystallization occurs, a very coarse recrystallized structure is generated and ridging resistance is not improved occurs.

According to the present inventors, the influence of recrystallization inhibition caused by Mg—Si-based particles is not a negligible problem. For example, the conventional technologies (Patent Literature 8 and 9) described above, which are technologies by which recrystallization is allowed to proceed by setting a temperature at which a rolled sheet that has been hot-rolled is wound at 300° C. or more and performing self-annealing, have been confirmed to be useful. However, even if the coiling temperature was controlled, the control would not be sufficient to improve the structure of a material in which such fine Mg—Si-based particles as described above are dispersed. Even if intermediate annealing is performed after the hot rolling, the effect caused by recrystallization is not always expectable.

Thus, the present inventors tried to control the state of the distribution of Mg—Si-based particles in an Al—Mg—Si-based alloy sheet material. In this examination, the present inventors summarized the features of the Mg—Si-based particles as described below.

(a) The state of the precipitation of Mg—Si-based particles is influenced by a cooling rate after homogenization treatment. When the cooling rate after the homogenization treatment is high, the precipitation of the Mg—Si-based particles occurs at a lower temperature, and particle sizes become small. When the cooling rate is high, the amounts of Mg and Si taken in solid solution states become large, and therefore, fine precipitation is further facilitated in subsequent heating.

(b) When an ingot of an aluminum alloy is heated to a hot-rolling temperature and retained, the Mg—Si-based particles precipitated after the homogenization treatment are coarsened in the processes of the heating and the retention.

(c) The state of the precipitation of the Mg—Si-based particles in (a) as described above and the rate of the coarsening by the heating in (b) are influenced by the content of Cu in the aluminum alloy. Specifically, an increase in the content of Cu tends to cause the Mg—Si-based particles to be finer. In addition, the rate of the coarsening of the Mg—Si-based particles by the heating is decreased with increasing the content of Cu. These actions by Cu are not negligible even when the content of Cu is slight, for example, an inevitable impurity level.

On the basis of the findings of (a), (b), and (c) described above, examples of manners for controlling the state of the distribution of Mg—Si-based particles include, first, decreasing a cooling rate after homogenization treatment on the basis of the findings of (a). This manner is a manner for inhibiting the precipitation itself of fine Mg—Si-based particles.

Coarsening of fine Mg—Si-based particles into appropriate sizes by intentional heating and retention at a temperature close to a hot-rolling temperature after homogenization treatment is also considered to be effective on the basis of the findings of (b). The precipitation of fine Mg—Si-based particles is not always able to be completely inhibited even if the cooling rate after the homogenization treatment is lowered. A case in which it is impossible to lower the cooling rate after the homogenization treatment can also be considered from the viewpoint of a production facility, production control, or the like. Thus, treatment to retain an ingot of an aluminum alloy at a temperature close to the hot-rolling temperature enables the Mg—Si-based particles to be coarsened, and this manner can be considered to be a particularly effective manner.

On the basis of the findings of (c), Cu influences both of the state and rate of the precipitation of Mg—Si-based particles, and therefore, it is effective to appropriately set the time of the heating and retention described above according to the content of Cu in consideration of the diffusion of Cu in a case in which it is considered to be necessary to strictly estimate the time.

On the basis of the findings described above, the present inventors set an appropriate cooling rate after homogenization treatment, intentionally retained an ingot after the homogenization treatment at a temperature close to a hot-rolling temperature, thereby coarsening the Mg—Si-based particles, and then performed hot rolling in order to control the state of the distribution of Mg—Si-based particles in a process for producing an Al—Mg—Si-based alloy sheet. In addition, it was found that a fine recrystallized structure can be formed by self-annealing using heat generated by winding in the hot rolling. It was found that as a result, a stripe-shaped structure caused by ingot crystal grains is decomposed, and the stripe-shaped structure can be completely eliminated by re-preforming recrystallization by subsequent solution treatment. A thus produced Al—Mg—Si-based alloy sheet material included an appropriately controlled material structure and was excellent in bending workability and ridging resistance.

In other words, the present disclosure is a method for producing an aluminum alloy rolled material for molding, the method including: a step of performing homogenization treatment of an ingot including an aluminum alloy including Si: 0.30 to 1.50 mass % (hereinafter referred to as "%"), Mg: 0.30 to 1.50%, Cu: 0.001 to 1.50%, at least any of 0.50% or less of Mn, 0.40% or less of Cr, and 0.40% or less of Fe, and the balance of Al and inevitable impurities; a cooling step of cooling the aluminum alloy after the homogenization treatment so that an average cooling rate in an ingot thickness of ¼ part from 500° C. to 320° C. is 20° C./h to 2000° C./h; and a step of starting hot rolling at 370° C. to 440° C. and winding the hot-rolled aluminum alloy at 310 to 380° C., wherein the method for producing an aluminum alloy rolled material for molding further includes a step of retaining the aluminum alloy after the cooling step for 0.17 hours or more at a heating temperature before rolling set within a range of 370° C. to 440° C. before the hot rolling.

As described above, the particle diameters of Mg—Si-based particles retained at the heating temperature before rolling are coarsened with time depending on a retention time at the temperature. In the present disclosure, when the aluminum alloy cooled after the homogenization treatment is retained at the heating temperature before rolling, it is preferable to control the particle diameters of precipitated particles by retaining the aluminum alloy for not less than the lower limit of a retention time calculated by Equation A described below.

$$\text{Lower limit of retention time (h)} = 3\ \text{(h)} \times \text{Cu amount coefficient} \times \text{cooling rate coefficient} \times \text{temperature history coefficient} \quad \text{(Equation A)}$$

wherein the lower limit of a retention time is set at 0.17 hours when the lower limit of a retention time in Equation A is less than 0.17 hours; and the meanings of the Cu amount coefficient, the cooling rate coefficient, and the temperature history coefficient in Equation A are described as follows:

Cu amount coefficient: Cu content (%) in aluminum alloy/reference Cu content (0.7%);

cooling rate coefficient: (average cooling rate (° C./h) in cooling step/reference cooling rate (90° C./h))$^{1/2}$; and temperature history coefficient: set at 0.3 or 1.0 based on heat history in (a) or (b) described below:

(a) temperature history coefficient=0.3 in a case in which the ingot is retained at the heating temperature before rolling without cooling the ingot to 320° C. or less in the cooling step; and (b) temperature history coefficient=1.0 in a case in which the ingot is cooled to 320° C. or less to room temperature in the cooling step, then heated, and retained at the heating temperature before rolling.

An increase in total rolling reduction in cold rolling of the hot-rolled material wound in the hot rolling enables a texture to be appropriately controlled and bending workability to be further improved.

In other words, the method for producing an aluminum alloy rolled material for molding of the present disclosure may include a step of performing cold rolling of the aluminum alloy after the hot rolling at a total cold rolling reduction of 65% or more and then performing solution treatment of the aluminum alloy.

Advantageous Effects of Invention

In accordance with the method for producing an aluminum alloy rolled material according to the present disclosure, an aluminum alloy rolled material having compatibility between high ridging resistance and bending workability can be produced.

DESCRIPTION OF EMBODIMENTS

Figure 1:
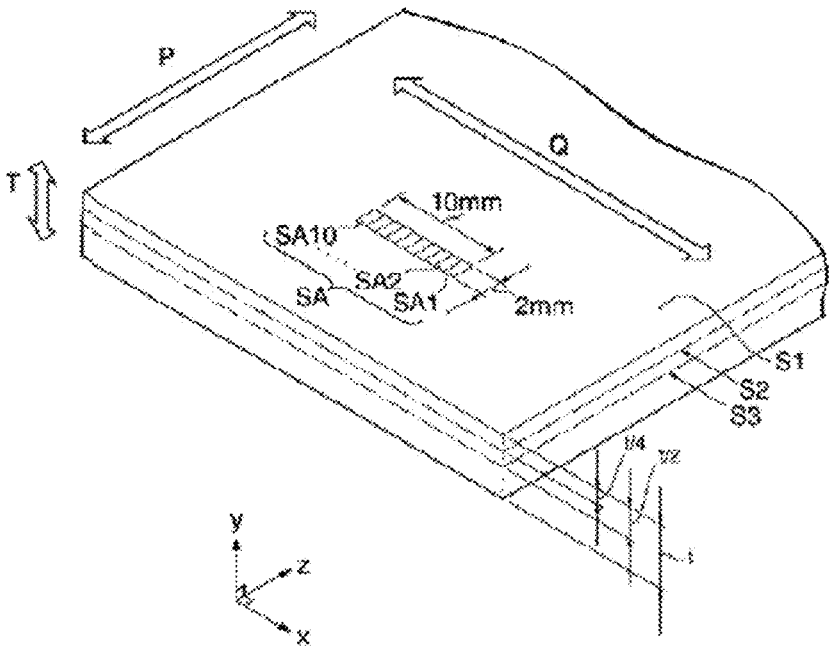
FIG. 1 is a descriptive diagram of planes (plane S2 and plane S3) in which textures are measured in an aluminum alloy rolled material produced by the present disclosure.

A method for producing an aluminum alloy rolled material according to the present disclosure will be specifically described below. In the following description, the alloy composition of an aluminum alloy to which the method according to the present disclosure is applied will be first described. In addition, each step of the method for producing an aluminum alloy rolled material according to the present disclosure will be detailed. Further, the mechanical characteristics and the texture of an aluminum alloy rolled material produced by the method according to the present disclosure will also be described.

(1) Alloy Composition of Aluminum Alloy Rolled Material as Subject of the Present Disclosure The method for producing an aluminum alloy rolled material according to the present disclosure is directed at an Al—Mg—Si-based aluminum alloy. The aluminum alloy is based on an aluminum alloy comprising Si, Mg, and Cu as essential constituent elements. The aluminum alloy can further include at least any of Cr, Mn, and Fe. The action and addition amount of each constituent element will be described below.

Si: 0.30 to 1.50%

Si is a fundamental alloy element in the alloy system of the present disclosure and contributes to improvement in strength in cooperation with Mg and Cu. The above-described effects are not sufficiently obtained when the amount of Si is less than 0.30%, while coarse Si particles and coarse Mg—Si-based particles are generated, resulting in the deterioration of bending workability, when the amount of Si is more than 1.50%. Accordingly, the amount of Si was set within a range of 0.30 to 1.50%. A Si amount within a range of 0.60 to 1.30% is preferred for allowing a balance between material strength and bending workability to be more favorable.

Mg: 0.30 to 1.50%

Mg is also a fundamental alloy element in the alloy system as a subject of the present disclosure and contributes to improvement in strength in cooperation with Si and Cu. The amount of a generated G.P. zone which contributes to improvement in strength due to precipitation hardening in coating baking becomes small, and therefore a sufficient improvement in strength is not obtained when the amount of Mg is less than 0.30%, while coarse Mg—Si-based particles are generated, resulting in the deterioration of bending workability, when the amount of Mg is more than 1.50%. Thus, the amount of Mg was set within a range of 0.30 to 1.50%. A Mg amount within a range of 0.30 to 0.80% is preferred for allowing the material strength and bending workability of a final sheet to be more favorable.

Cu: 0.001 to 1.50%

Cu is an important optional constituent element because of contributing to improvement in strength in cooperation with Si and Mg. Cu can influence the precipitation state and coarsening rate of Mg—Si-based particles as described above, and is therefore also an important constituent element in this sense. It is necessary to set the content of Cu in the aluminum alloy as a subject of the present disclosure at 1.50% or less. This is because more than 1.50% of Cu results in generation of coarse Mg—Si—Cu-based particles and in the deterioration of bending workability.

The preferred content of Cu depends on the objective of an aluminum alloy rolled material to be produced. Tensile strength can be improved by adding 0.30% or more and 1.50% or less of Cu when importance is placed on the moldability of the aluminum alloy. In contrast, it is preferable to reduce the content of Cu, preferably to less than 0.10%, when importance is placed on the corrosion resistance of the aluminum alloy. The content of Cu may be set at 0.10% or more and less than 0.30% when importance is placed on a balance between corrosion resistance and moldability. In the present disclosure, the lower limit of the content of Cu was set at 0.001% in consideration of the action of Cu described above.

Mn: 0.50% or Less, Cr: 0.40% or Less

Mn and Cr are elements effective at allowing crystal grains to be finer and at stabilizing a structure. However, a Mn content of more than 0.50% or a Cr content of more than 0.40% may cause not only saturation of the above-described effects but also generation of a large number of intermetallic compounds, resulting in an adverse impact on moldability, particularly hem-bendability. Accordingly, Mn is set at 0.50% or less, and Cr is set at 0.40% or less. With regard to the lower limits of the contents of Mn and Cr, when the content of Mn is less than 0.03% or the content of Cr is less than 0.01%, the above-described effects are not sufficiently obtained, crystal grains are coarsened in solution treatment, and a surface may be roughened in hemming-bending. Thus, the contents of Mn and Cr are preferably set at Mn: 0.03 to 0.50% and Cr: 0.01 to 0.40%.

With regard to Mn and Cr, more than 0.15% of Mn or more than 0.05% of Cr may result in an excessive increase in the above-described effects and in inhibition of recrystallization in self-annealing after hot-rolling winding. Thus, further restrictions on Mn and Cr may be preferred in consideration of a balance with other additional elements. In such a case, Mn is more preferably 0.03% or more and 0.15% or less. Cr is more preferably 0.01% or more and 0.05% or less.

Fe: 0.40% or Less

Fe is also an element effective at improving strength and allowing crystal grains to be finer, but more than 0.40% of Fe may cause a large number of intermetallic compounds to be generated and bending workability to be deteriorated. Thus, the amount of Fe is set at 0.40% or less. With regard to the lower limit of the amount of Fe, a Fe amount of less than 0.03% may result in an insufficient effect. Thus, it is preferable to set the amount of Fe within a range of 0.03 to 0.40%. It is more preferable to set the amount of Fe at 0.03% to 0.20% when further bending workability is demanded.

The aluminum alloy in the present disclosure may fundamentally comprise Al and inevitable impurities as well as Si, Mg, Cu, Cr, Mn, and Fe described above.

(2) Method for Producing Aluminum Alloy Rolled Material According to the Present Disclosure The method for producing an aluminum alloy rolled material for molding according to the present disclosure will now be described. It is optimal to subject an ingot with predetermined constituent composition to homogenization treatment, cooling, and hot rolling, and then to cold rolling and solution treatment in combination, in the production of the aluminum alloy rolled material of the present disclosure. The method for producing the aluminum alloy rolled material according to the present disclosure will be described in detail below.

First, the aluminum alloy with the constituent composition described above is melted according to a usual method, and cast by selecting a usual casting method such as a continuous casting method or a semi-continuous casting method (DC casting method) as appropriate. The obtained ingot is subjected to homogenization treatment. Treatment conditions in the case of performing the homogenization treatment are not particularly limited, but heating may be performed typically at a temperature of 500° C. or more and 590° C. or less for 0.5 hours or more and 24 hours or less.

The ingot subjected to the homogenization treatment is cooled and hot-rolled. In the method for producing an aluminum alloy rolled material according to the present disclosure, it is needed to define the range of a cooling rate after the stage of ending the homogenization treatment and to intentionally retain the ingot at a set heating temperature before rolling for not less than a predetermined time before starting the hot rolling after cooling the ingot. With regard to the cooling rate after the stage of ending the homogenization treatment, the cooling is performed so that an average cooling rate at a temperature of from 500° C. to 320° C. in an ingot thickness of ¼ part is from 20° C./h to 2000° C./h. The reason that the cooling rate after the homogenization treatment is defined as described above is because an excessively high cooling rate tends to result in precipitation of fine Mg—Si-based particles. In addition, this is because when the cooling rate is excessively low, Mg—Si-based particles having sizes necessary for promoting recrystallization coarsely precipitate, and wasting time is needed for making the particles into a solid solution in final heat treatment (in solution treatment). It is preferable to set the cooling rate at 50° C./h to 1000° C./h.

In the present disclosure, a position at which the temperature of the ingot is measured is set at a thickness of ¼ part (the same hereinafter) of the total thickness from the surface during the measurement of the cooling rate. In addition, a position at which the temperature of the ingot is measured is also set at a thickness of ¼ part in the case of temperature management in retention at a heating temperature before rolling described later. This is because the temperature of a surface layer of the ingot widely changes, and therefore, it is difficult to appropriately measure the cooling rate. Although stable temperature measurement is also possible in the center of the ingot, a delay in temperature change may occur to some degree, and an ingot thickness of ¼ part is preferred in consideration of strict management of the cooling rate or the retention time. The temperature in an ingot thickness of ¼ part may be measured using an ingot in which a thermocouple is embedded or may be calculated using a heat transfer model. The temperature of an ingot in the following description means the temperature in an ingot thickness of ¼ part.

On the basis of the temperature of the ingot after the cooling step, plural patterns can be adopted for the heat history of the ingot after the cooling after the homogenization treatment. First, the ingot is cooled from the homogenization treatment temperature so as to be prevented from being cooled to 320° C. or less, and the ingot is then retained at the heating temperature before rolling set within a range of 370° C. to 440° C. before the hot rolling. In such a case, the ingot may be retained at the heating temperature before rolling when the temperature of the ingot reaches the heating temperature before rolling from the homogenization treatment temperature. It is preferable to slightly heat the ingot to the heating temperature before rolling and retain the ingot when the ingot is cooled to a temperature of more than 320° C. and less than the heating temperature before rolling. The reason that the temperature of the ingot after the cooling step is based on 320° C. as described above is because fine Mg—Si-based particles are inhibited from precipitating. Accordingly, in view of heat and energy, it is effective to cool the ingot from the homogenization treatment temperature to more than 320° C., particularly to a hot-rolling temperature in a straight manner, in the cooling step after the homogenization treatment.

However, the ingot may be temporarily cooled to a temperature in a range of 320° C. to room temperature in the cooling step. Even when the ingot is temporarily cooled to a temperature in the range of 320° C. to the room temperature, fine Mg—Si-based particles can be coarsened by re-heating the ingot to the heating temperature before rolling and retaining the ingot at the heating temperature before rolling. Thus, the ingot with such a heat history is not problematic at all for producing a final sheet of an aluminum alloy excellent in ridging resistance and bendability. The temporal cooling of the ingot to a temperature in the range of 320° C. to the room temperature and the re-heating of the ingot are useful for obtaining stable product characteristics. When such re-heating is performed, time is needed for coarsening Mg—Si-based particles as represented by a heat history coefficient in Equation A described later; however, due to the time, excessive coarsening is inhibited even in the case of retention for long time at the heating temperature before rolling. As a result, the deterioration of strength characteristics and bending workability caused by incompletely melting coarse particles in solution treatment is inhibited.

In the present disclosure, the ingot is retained at the heating temperature before rolling set within a range of 370° C. to 440° C. before starting the hot rolling. Mg—Si-based particles are grown and coarsened by the retention at the heating temperature before rolling.

The reason that the heating temperature before rolling is set at 370° C. to 440° C. is because the temperature is needed for coarsening finely precipitated Mg—Si-based particles. The range of the heating temperature before rolling is the same as the range of the hot-rolling temperature. Accordingly, the heating temperature before rolling and the hot-rolling temperature may be set at the same temperature. In such a case, the ingot after the cooling step is retained at the hot-rolling temperature for predetermined time (0.17 hours or more), and the hot rolling of the ingot can be started on an as-is basis. The heating temperature before rolling and the hot-rolling temperature may also be set at different temperatures. In such a case, the ingot heated and retained at the heating temperature before rolling is cooled or re-heated, and the hot rolling of the ingot is then started. However, even a case in which the heating temperature before rolling and the hot-rolling temperature are set at different temperatures is not problematic if both of the temperatures are set in a range of 370° C. to 440° C.

The lower limit of retention time (h) for which the ingot is retained at the heating temperature before rolling is set at 0.17 hours. The retention time is a value obtained based on the results of various tests conducted by the present inventors and is minimum required heating retention time regardless of the composition of the aluminum alloy and the heat history after the homogenization treatment. The temperature of the ingot is a temperature in an ingot thickness of ¼ part as described above.

In fact, the optimal range of the retention time at the heating temperature before rolling is considered to exist depending on various conditions such as the composition of the aluminum alloy and the heat history after the homogenization treatment. Examples of the conditions include, first, the content of Cu in the aluminum alloy. This is because the dispersion state and coarsening rate of Mg—Si-based particles vary depending on the content of Cu as described above. The retention time at the heating temperature before rolling is influenced by the content of Cu even when the content of Cu is slight, for example, a content which is an inevitable impurity level.

Examples of the conditions that can determine the retention time also include the heat history of the aluminum alloy after the homogenization treatment. The heat history is either the history of retaining the aluminum alloy at the heating temperature before rolling so that the aluminum alloy is prevented from being cooled to 320° C. or less after the homogenization treatment or the history of cooling the aluminum alloy to a temperature in the range of 320° C. to room temperature after the homogenization treatment, then re-heating the aluminum alloy to the heating temperature before rolling, and retaining the aluminum alloy at the heating temperature before rolling.

Further, the retention time at the heating temperature before rolling can also be determined by a cooling rate after the homogenization treatment (average cooling rate of ingot from 500° C. to 320° C.).

The present inventors found preferred retention time in consideration of the various conditions. The retention time at the heating temperature before rolling is preferably set at not less than the lower limit of a retention time (h) calculated by Equation A described below.

Lower limit of retention time (h)=3 (h)×Cu amount coefficient×cooling rate coefficient×temperature history coefficient (Equation A)

wherein the lower limit of a retention time is set at 0.17 hours when the lower limit of a retention time in Equation A is less than 0.17 hours; and the meanings of the Cu amount coefficient, the cooling rate coefficient, and the temperature history coefficient in Equation A are described as follows:

Cu amount coefficient: Cu content (%) in aluminum alloy/reference Cu content (0.7%);

cooling rate coefficient: (average cooling rate (° C./h) in cooling step/reference cooling rate (90° C./h))$^{1/2}$; and temperature history coefficient: set at 0.3 or 1.0 based on heat history in (a) or (b) described below:

(a) temperature history coefficient=0.3 in a case in which the ingot is retained at the heating temperature before rolling without cooling the ingot to 320° C. or less in the cooling step; and (b) temperature history coefficient=1.0 in a case in which the ingot is cooled to 320° C. or less to room temperature in the cooling step, then heated, and retained at the heating temperature before rolling.

Mg—Si-based particles can be easily controlled to have appropriate particle sizes by retaining the aluminum alloy for not less than the lower limit of a retention time calculated by the above-described Equation A. The equation is a mathematical expression derived by organizing cooling conditions and the amount of Cu in Al after homogenization treatment on the basis of various kinds of experimental data.

In the case of retention at a heating temperature before rolling without performing cooling after homogenization treatment to a temperature of 320° C. or less, the growth of Mg—Si-based particles is promoted after precipitation of Mg—Si-based particles, and therefore, a short time for coarsening to appropriate particle sizes is acceptable. The reason that the heat history coefficient in Equation A is set at 0.3 is because the above is intended. In contrast, in the case of temporally performing cooling to a temperature in the range of 320° C. to room temperature and then performing re-heating to the heating temperature before rolling, fine Mg—Si-based particles are precipitated in a low-temperature region in the process of cooling after the homogenization treatment and in the process of increasing temperature from room temperature. It is found that long time is needed until control to appropriate particle sizes as compared with the case of retention at a heating temperature before rolling without cooling to 320° C. or less after cooling because it is necessary to coarsen the precipitates in the present disclosure. The reason that the heat history coefficient in Equation A is set at 1.0 is because the above is intended.

However, when the lower limit of a retention time calculated by Equation A is less than 0.17 hours, the lower limit of a retention time is set at 0.17 hours. In the case of the low content of Cu, a low cooling rate, and/or the like, fine precipitation of Mg—Si-based particles can be inhibited, and the lower limit of a retention time before hot rolling can be theoretically considerably decreased. According to the examination by the present inventors, however, it is impossible to completely eliminate the possibility of the fine precipitation of Mg—Si-based particles even in such a case, and it is preferable to perform heating retention to some extent. Thus, the minimum retention time was set at 0.17 hours.

The retention time before hot rolling is not particularly restricted as long as being not less than the lower limit of a retention time calculated by Equation A. If the temperature of the ingot is within the range of the heating temperature before rolling, the lower limit of the retention time may be achieved by addition of a time for which the ingot is in a furnace, a migration time, and a waiting time on a hot-rolling table. The upper limit of the retention time is not particularly restricted, but hot rolling is performed after retention for 24 hours or less in usual operation.

Coarse precipitated particles grown by the retention at the heating temperature before rolling become the nucleation sites of recrystallization and have the action of promoting the recrystallization. In the material structure of the alloy appropriately retained at the heating temperature before rolling, when precipitated particles having a particle diameter of 0.4 μm to 4.0 μm in crystal grains that can be observed with a scanning electron microscope are extracted, the average particle diameter of the precipitated particles is preferably 0.6 μm or more, and more preferably 0.8 μm or more. A reduction in the number of fine particles constituting obstacles to grain boundary migration for recrystallization also promotes the recrystallization. Thus, the total number of precipitated particles having a particle diameter of 0.04 μm to 0.40 μm in crystal grains that can be observed with a scanning electron microscope is preferably 1500 particles/100 $\mu m^2$ or less.

Hot rolling is performed according to a conventional and common method after the homogenization treatment, the cooling, and the retention in the hot rolling in such a manner as described above. A temperature for the hot rolling is set at a temperature within a range of 370° C. to 440° C. The hot-rolling temperature or a winding temperature described later is the temperature of a sheet surface or coil-side wall surface of a workpiece material. Such temperatures can be measured with a contact type thermometer or a non-contact type thermometer.

In the step of the hot rolling, it is important to set the winding temperature after the hot rolling. In the present disclosure, an appropriate particle distribution is obtained by the cooling and the retention at the heating temperature before rolling after the homogenization described above, and an ingot with the action of promoting recrystallization by coarse precipitated particles and in the state of a small number of fine particles obstructing grain boundary migration is hot-rolled. Appropriate setting of the winding temperature of the obtained hot-rolled sheet allows recrystallization to occur due to self-annealing and can result in a recrystallized fine structure on which a material structure for improving ridging resistance is based.

In the present disclosure, the winding temperature after the hot rolling is set at 310 to 380° C. When the winding temperature is less than 310° C., it is impossible to stably obtain a recrystallized structure by self-annealing even if an appropriate particle distribution is obtained before starting the hot rolling. Even if a recrystallized structure is obtained by self-annealing, a winding temperature of more than 380° C. results in the deterioration of ridging resistance because the recrystallized grains are coarse.

After the self-annealing after the hot rolling, cold rolling is performed until a product sheet thickness is achieved. A total cold rolling reduction from a hot-rolled sheet thickness to the product sheet thickness is preferably 65% or more. The cold rolling allows a rolling texture to be grown, whereby recrystallized grains grow while eroding a rolling texture constituent in solution treatment following the cold rolling, and an aluminum alloy rolled material including a preferred texture can be obtained.

The aluminum alloy sheet for molding particularly excellent in bendability and ridging resistance can be obtained by further subjecting the aluminum alloy sheet allowed to have a predetermined sheet thickness in such a manner as described above to solution treatment serving as recrystallization treatment. It is preferable that a material achieving temperature in a sheet thickness of ¼ part is set at 500° C. or more and 590° C. or less, and a retention time at the material achieving temperature is set at no retention to 5 minutes or less as the conditions of the solution treatment serving as the recrystallization treatment.

In order to impart favorable bake hardenability to the aluminum alloy sheet produced in such a manner as described above, it is possible to perform preliminary ageing treatment by which the aluminum alloy sheet is retained for 1 hour or more in a temperature range of 50 to 150° C. immediately after the solution treatment. However, the preliminary ageing treatment does not essentially influence the texture. Thus, whether or not preliminary ageing treatment is performed is not an essential requirement in the present disclosure aimed at improvement of ridging resistance influenced by a material structure.

(3) Mechanical Characteristics of Aluminum Alloy Rolled Material Produced by the Present Disclosure The mechanical characteristics of the aluminum alloy rolled material described above and produced by the present disclosure are not particularly limited. In fact, in the present disclosure, the aluminum alloy rolled material preferably has a tensile strength of 200 MPa or more and a difference between the tensile strength and a 0.2% proof stress of 100 MPa or more as the mechanical properties of the aluminum alloy rolled material in consideration of becoming a material for molding of the member or the like of an automobile, a ship, an aircraft, or the like. In particular, because a common Al—Mg—Si-based alloy for an automobile panel has a difference between a tensile strength and a 0.2% proof stress of 100 MPa or more, the aluminum alloy rolled material becomes an aluminum alloy rolled material excellent in workability and ridging resistance in the application when including the conditions. With regard to the strength of the aluminum alloy rolled material, the tensile strength is preferably 220 MPa or more. In addition, the difference between the tensile strength and a 0.2% proof stress is preferably 110 MPa or more.

(4) Texture of Aluminum Alloy Rolled Material Produced by the Present Disclosure The aluminum alloy rolled material produced by the method according to the present disclosure includes favorable characteristics in both ridging resistance and bending workability. According to the present inventors, the aluminum alloy rolled material produced by the method according to the present disclosure includes a texture exhibiting distinguishing characteristics. Specifically, the aluminum alloy rolled material includes features relating to a relationship between a cube orientation density and a random orientation, and the deviation of an average Taylor factor in a predetermined plane of the aluminum alloy sheet material. Each characteristic will be described below.

(4.1) Texture Based on Cube Orientation Density as Index, and Bending Workability The aluminum alloy rolled material produced by the present disclosure preferably includes a texture that is appropriately controlled based on a cube orientation density as an index. This is because bending workability is improved stably. The cube orientation density is the orientation density of a crystal grain with a cube orientation ({100}<001> orientation). Specifically, the ratio of the cube orientation density to a random orientation is preferably 10 or more in a plane that is orthogonal to a sheet thickness direction and is at a depth of ¼ of a total sheet thickness from the surface. Crystal grains with a cube orientation inhibit a shear zone from being generated in hemming-bending and inhibit a bending crack from occurring and propagating along a shear zone. The bending workability can be improved by increasing the rate of cube orientation crystal grains inhibiting the formation and propagation of a shear zone by controlling the ratio of the cube orientation density to 10 or more. It is more preferable to set the ratio of the cube orientation density at 25 or more for achieving further strict appearance quality after bending.

The reason that attention is focused on the texture in the plane that is orthogonal to a sheet thickness direction and is at a depth of ¼ of a total sheet thickness as a reference of the bending workability improvement is because the vicinity of a surface layer of a sheet particularly influences surface quality under a very severe processing condition, hemming-bending, according to the present inventors.

The measurement of a cube orientation density will be specifically described with reference to FIG. 1. First, a plane S2 that is orthogonal to a sheet thickness direction T and is at a depth of ¼ of a total sheet thickness t from a sheet surface S1 is exposed by mechanical polishing. Then, the orientation information of a texture is acquired by measuring the incomplete pole figures of a (111) plane, a (220) plane, and a (200) plane by reflection method of Schulz which is one of X-ray diffraction measurement methods at an inclination angle ranging from 15 to 900. The cube orientation density can be determined based on the obtained orientation information of the texture by using pole figure analysis software.

For example, analysis software "Standard ODF" publicly distributed by Hirofumi Inoue [Associate Professor] in Osaka Prefecture University or "OIM Analysis" manufactured by 1TSL may be used as the analysis software. Specifically, first, the orientation information of the texture obtained by the above-described method is subjected to rotation operation as needed and to series expansion on the conditions that the expansion degrees of"even number term" and "odd number term" are "22" and "19", respectively, thereby determining a crystal orientation distribution function (ODF). The orientation density of each orientation obtained by the ODF can be calculated as a ratio with respect to the orientation density of a standard sample including a random texture obtained by sintering an aluminum powder (random ratio).

(4.2) Texture Based on Taylor Factor as Index, and Ridging Resistance

In the present disclosure, not only bending workability but also ridging resistance is improved, and the aluminum alloy rolled material with the preferably balanced characteristics is produced. It is preferable to appropriately control the texture of the aluminum alloy rolled material which is a final sheet on the basis of a Taylor factor as an index with regard to the ridging resistance. In other words, it is preferable to control the texture so that the dispersion of average Taylor factors in a rolling width direction is within an appropriate range for obtaining high-level ridging resistance.

A ridging mark is a fine recessed and projected pattern that is generated in a stripe shape in a direction parallel to a rolling direction when a rolled sheet is molded. The mechanism of the generation of the ridging mark is considered to be based on a difference between the plastic deformation amounts of crystal orientations adjacent to each other in molding.

The actual strain state of an press molded component in the case of press molding of a rolled sheet is known to be distributed primarily in a region between a plane strain state and an equibiaxial strain state. It is considered that a ridging mark is most prominently generated due to the plane strain of which the rolling width direction (direction orthogonal to a rolling direction and parallel to a sheet surface) is a main strain direction, of the strains in the region. The plane strain deformation in the rolling width direction can be considered to be a strain state in which only extension in the rolling width direction and decrease in sheet thickness occur.

The dispersion (fluctuation range) of Taylor factor values in a rolling width direction in a case in which molding is regarded as plane strain deformation in the rolling width direction allowed to be a main strain direction is an effective index for ridging resistance. The Taylor factors are calculated from all crystal orientations existing in the texture, and the reduction of the dispersion of Taylor factors in a rolling width direction in a case in which molding is regarded as plane strain deformation in the rolling width direction allowed to be a main strain direction in a sheet surface of the rolled sheet or a plane in a sheet parallel to the sheet surface is effective for improving ridging resistance.

The absolute value of the difference between the maximum and minimum values of average Taylor factors in a case in which molding is regarded as plane strain deformation in a rolling width direction allowed to be a main strain direction in corresponding divided regions in the same plane, obtained by dividing a region of 10 mm in the rolling width direction and 2 mm in a rolling direction into 10 equal regions in the rolling width direction, is preferably 1.0 or less in a plane that is orthogonal to a sheet thickness direction and is at a depth of ½ of a total sheet thickness from the surface in the control of the texture based on a Taylor factor as an index in the aluminum alloy rolled material produced in the present disclosure. The absolute value of the difference between the maximum and minimum values of the average Taylor factors is more preferably 0.9 or less.

The index will be specifically described with reference to FIG. 1. FIG. 1 clearly illustrates three planes S1, S2, and S3 which are the sheet surface S1 that is orthogonal to a sheet thickness direction T, the plane S2 that is orthogonal to the sheet thickness direction T and is at a depth of ¼ of a total sheet thickness t from the sheet surface S1, and the plane S3 that is orthogonal to the sheet thickness direction T and is at a depth of ½ of the total sheet thickness t from the sheet surface S. In the present disclosure, in the plane S3 among the surfaces, a region SA of 10 mm in a rolling width direction Q and 2 mm in a rolling direction P is made in an arbitrary site in the plane, divided regions SA1, SA2, . . . , SA10 in the same plane are obtained by dividing the region SA into 10 equal regions in the rolling width direction Q, and the value of the average Taylor factor of each of the divided regions SA1, SA2, . . . , SA10 is measured. The average value of Taylor factors in a case in which molding is regarded as plane strain deformation in the rolling width direction Q allowed to be a main strain direction is measured as described above. A ridging mark can be stably inhibited from being generated in the molding by controlling the absolute value of the difference between the maximum and minimum values of the measurement values of the corresponding divided regions SA1, SA2, . . . , SA10 to be 1.0 or less, that is, by reducing the maximum value of the dispersion of the values of the average Taylor factors of the micro-regions (the corresponding divided regions SA1, SA2, . . . , SA10) in the plane S3 in the rolling width direction to 1.0 or less.

In contrast, when the absolute value of the difference between the maximum and minimum values of the values of the average Taylor factors of the corresponding divided regions SA1, SA2, . . . , SA10 defined as described above is more than 1.0, the local dispersion of plastic deformation amounts in the rolling width direction becomes noticeable, ridging resistance is deteriorated, and a ridging mark may be generated.

In the present disclosure, the region of 10 mm in the rolling width direction and of 2 mm in the rolling direction is set, and the divided regions obtained by dividing the region into the 10 equal regions in the rolling width direction are targets for the measurement of the average Taylor factors. The difference between the maximum and minimum values of the average Taylor factors measured in the corresponding divided regions is regarded as an index for evaluating ridging resistance. The validity of the settings of the shapes, dimensions, and division number of the regions of the measurement of the average Taylor factors was confirmed by the present inventors. The present inventors confirmed by experiment that ridging resistance can be reliably and effectively evaluated based on the settings.

In the present disclosure, the maximum value of the dispersion of the average Taylor factors in the rolling width direction is defined only in the plane S3, that is, the plane located in the center of the sheet thickness. The reason that only the presence or absence of the dispersion of the average Taylor factors in the plane S3 is regarded as the index for evaluating ridging resistance is because it is preferable to determine the presence or absence of the generation of a ridging mark on the basis of the state of crystals in this region. Like the plane S3, the states of crystals in the sheet surface (plane S1) and the plane (plane S2) at a depth of ¼ plane of the total sheet thickness can also influence the generation of a ridging mark, and a band-shaped structure which influences the generation of a ridging mark remains most easily in the vicinity of the center of the sheet thickness. Accordingly, an aluminum alloy rolled material can be considered to be improved in ridging resistance intended by the present disclosure by allowing the state of the crystals of the plane S3 to be a favorable state and confirming the state. The reason that the maximum value of the dispersion of the average Taylor factors is regarded as the index is because the present disclosure is intended to decompose a band-shaped structure, and the index is preferred for evaluating the state of a texture formed depending on the success or failure thereof.

Accordingly, the present disclosure does not deny that divided regions are set in the plane S1 and the plane S2 like plane S3 and the dispersion of Taylor factors is measured. Further, it is not intended to exclude that the results of the dispersion of the Taylor factors in the plane S1 and the plane S2 are equivalent to or better than the results of the dispersion of the plane S3 required by the present disclosure.

A specific method for measuring an average Taylor factor value in each of the predetermined divided regions in the plane S3 that is orthogonal to the sheet thickness direction and is at a depth of ½ of the total sheet thickness from the sheet surface S1 will now be described. First, the surface S3 of ½ of the total sheet thickness which becomes a measurement plane is exposed. This exposure can be performed by mechanical polishing, buffing-polishing, or electrolytic polishing. The orientation information of the texture is acquired by measuring each of the predetermined divided region ranges continuous in the rolling width direction in the exposed plane S3 per visual field with a backscattered electron diffraction measurement apparatus (SEM-EBSD) attached to a scanning electron microscope. A STEP size for the measurement may be set at around 1/10 of a crystal particle diameter.

An average Taylor factor is determined from the obtained orientation information using EBSD analysis software. For example, "OIM Analysis" manufactured by TSL may be used as the analysis software. Specifically, first, the orientation information of the texture obtained by the above-described method is subjected to rotation operation as needed so that measurement data shows the orientation information in the case of being viewed from the sheet thickness direction. Then, average Taylor factors in the corresponding divided regions can be calculated by calculating an average Taylor factor under a plane strain state in which the sheet thickness decreases and the rolling width direction extends on a measurement data basis in each visual field. The calculation can be performed on the assumption that an active primary slip system is {111}<110>. The average Taylor factors in the corresponding divided regions are calculated in such a manner, and the difference between the maximum and minimum values of the average Taylor factors is calculated, thereby evaluating ridging resistance.

Examples

More specific examples of the method for producing an aluminum alloy rolled material for molding according to the present disclosure will now be described. In the examples, plural aluminum alloy rolled material for molding with different compositions were produced while adjusting production conditions. The mechanical properties and textures of the produced aluminum alloy rolled material were measured and evaluated, and tests for evaluating the mechanical characteristics (tensile strength and 0.2% proof stress), bending workability, and ridging resistance of the aluminum alloy rolled material were conducted.

(i) Production of Aluminum Alloy Rolled Material

First, the ingots of aluminum alloys with compositions shown in Table 1 were made by DC casting. The obtained ingot (lateral cross-section dimensions: thickness of 500 mm, width of 1000 mm) was subjected to homogenization treatment at 550° C. for 6 hours, then subjected to a cooling step, retained at a heating temperature before rolling, and then subjected to hot rolling. In the present embodiment, the heating temperature before rolling and a hot-rolling temperature were set at the same temperature. As heat histories between the cooling and the hot rolling after the homogenization treatment, two patterns of a case in which after the homogenization treatment, the ingot was cooled to the heating temperature before rolling and retained at the heating temperature before rolling without being allowed to be at 320° C. or less (direct retention), and a case in which the ingot after the homogenization treatment was cooled to room temperature, re-heated to the heating temperature before rolling, and retained at the heating temperature before rolling (re-heating) were performed. The cooling rates, the heat histories, and the heating temperatures before rolling in the present examples are shown in Table 2. The rate of cooling an ingot was measured by measuring the temperature of ¼ part of the ingot. The cooling rate was measured using a dummy slab in which a thermocouple was embedded, and which had the same size. The ingot was retained at the heating temperature before rolling with reference to the lower limit of a retention time calculated by application of the Equation A described above depending on the content of Cu in the aluminum alloy and the heat history described above.

Then, the hot rolling was performed. A temperature at which the hot-rolled sheet after the hot rolling was wound was adjusted as shown in Table 2. After the hot rolling, cold rolling and solution treatment were performed. A rolling reduction in the cold rolling was shown in Table 2. In the solution treatment, solution treatment was performed in a continuous annealing furnace on conditions of 550° C. and 1 minute, and preliminary ageing treatment was performed at 80° C. for 5 hours immediately after forced-air cooling with a fan to around room temperature. The aluminum alloy rolled materials according to Disclosure Examples and Comparative Examples were produced by the above steps.

In the present examples, the state of the distribution of Mg—Si-based particles in the aluminum alloy ingot before the hot rolling was also examined. In the examination, a small piece sample was cut from a thickness of ¼ part in the center of the width of the ingot at a position of 500 mm from an end of the ingot after the casting of the above-described test material. Samples of which the heat histories (heat histories from homogenization treatment to retention at the heating temperature before rolling, before hot rolling) equivalent to those of Disclosure Examples and Comparative Examples in Table 2 were reproduced in a laboratory were generated, mirror-polishing of surfaces of the samples was performed, and the images of the surfaces were then taken with FE-SEM and subjected to image analysis. In the evaluation of the material structures, precipitated particles having a particle diameter of 0.4 μm to 4.0 μm in crystal grains that were able to be observed in the SEM images were extracted, and the average particle diameter of the particles was calculated. In addition, the number of precipitated particles having a particle diameter of 0.04 μm to 0.40 μm in the crystal grains that were able to be observed in the SEM images was quantified. The results are shown in Table 2.

Further, the state of recrystallization after the hot rolling was confirmed. In a method of the confirmation, the three outer windings of the hot-rolled sheet were removed, and a sample was then collected from the center in a width direction. The crystal grain structures of cross sections parallel in a rolling direction were photographed, and visual determination was performed whether recrystallization occurred at 100 lattice points obtained by drawing 10 evenly spaced straight lines in a visual field of 2 mm×4 mm in longitudinal and lateral directions, respectively. The number of lattice points corresponding to recrystallized grains was defined as a recrystallization rate, and a case in which the recrystallization rate was 95% or more was defined as generation of a recrystallized structure.

TABLE 11

| | Chemical component (mass %) | | | | | | | | | |
|---|---|---|---|---|---|---|---|---|---|---|
| Alloy | Si | Fe | Cu | Mn | Mg | Cr | Zn | Ti | Al | AA |
| A | 0.74 | 0.16 | 0.68 | 0.12 | 0.68 | 0.02 | 0.03 | 0.02 | Bal. | 6111 |
| B | 0.71 | 0.17 | 0.22 | 0.08 | 0.70 | 0.01 | 0.15 | 0.03 | Bal. | 6061 |
| C | 0.68 | 0.10 | 0.32 | 0.14 | 0.72 | 0.01 | 0.17 | 0.01 | Bal. | 6061 |
| D | 0.73 | 0.18 | 1.40 | 0.09 | 0.70 | 0.04 | 0.10 | 0.02 | Bal. | — |
| E | 0.69 | 0.17 | 1.61 | 0.11 | 0.68 | 0.02 | 0.08 | 0.04 | Bal. | — |
| F | 0.27 | 0.13 | 0.72 | 0.14 | 0.73 | 0.03 | 0.23 | — | Bal. | — |
| G | 0.34 | 0.20 | 0.79 | 0.12 | 0.76 | 0.02 | 0.26 | 0.09 | Bal. | — |
| H | 1.41 | 0.13 | 0.69 | 0.01 | 0.70 | — | 0.16 | 0.02 | Bal. | 6110 |
| I | 1.61 | 0.16 | 0.67 | 0.13 | 0.70 | 0.01 | 0.21 | 0.02 | Bal. | — |
| J | 0.71 | 0.02 | 0.70 | 0.06 | 0.26 | 0.01 | 0.19 | 0.03 | Bal. | — |
| K | 0.77 | 0.02 | 0.78 | 0.01 | 0.33 | 0.03 | 0.33 | 0.03 | Bal. | — |
| L | 0.72 | 0.02 | 0.67 | 0.04 | 1.42 | — | 0.09 | 0.02 | Bal. | — |
| M | 0.67 | 0.18 | 0.68 | 0.09 | 1.63 | 0.02 | 0.11 | 0.06 | Bal. | — |
| N | 1.02 | 0.18 | 0.02 | 0.07 | 0.51 | — | 0.01 | 0.02 | Bal. | 6016 |
| O | 1.42 | 0.17 | 0.001 | — | 0.48 | 0.05 | — | 0.02 | Bal. | 6016 |
| P | 0.39 | 0.11 | 0.08 | 0.16 | 0.79 | 0.01 | 0.04 | 0.03 | Bal. | — |
| Q | 0.71 | 0.22 | 0.12 | 0.08 | 1.43 | 0.09 | 0.09 | 0.04 | Bal. | — |
| R | 0.74 | 0.01 | 0.54 | 0.02 | 0.49 | — | — | 0.01 | Bal. | — |
| S | 0.65 | 0.08 | 0.63 | 0.43 | 0.61 | 0.01 | 0.01 | 0.02 | Bal. | — |
| T | 0.69 | 0.15 | 0.63 | 0.55 | 0.64 | 0.03 | 0.02 | 0.02 | Bal. | — |
| U | 0.66 | 0.06 | 0.64 | 0.02 | 0.63 | 0.35 | 0.01 | 0.02 | Bal. | — |
| V | 0.72 | 0.17 | 0.68 | 0.11 | 0.62 | 0.43 | 0.01 | 0.03 | Bal. | — |
| W | 0.69 | 0.37 | 0.70 | 0.11 | 0.64 | 0.01 | 0.01 | 0.02 | Bal. | — |
| X | 0.70 | 0.45 | 0.69 | 0.08 | 0.64 | 0.01 | 0.01 | 0.02 | Bal. | — |

The mark "—" shows that a content was not more than a detection limit.

TABLE 2

| | | | Retention conditions at heating temperature before rolling | | | | Precipitate of ingot before hot rolling | | | | | | |
|---|---|---|---|---|---|---|---|---|---|---|---|---|---|
| Production process | Alloy | Cooling rate after homogenization (° C./h) | Heat history*1 | Temperature (° C.)*2 | Time (h) calculated by Equation A | Actual performance time (h) | Average particle diameter (μm) | Number (particles/100 μm²) | Hot-rolling winding temperature (° C.) | Recrystallization rate | Intermediate annealing | Cold rolling reduction (%) | Classification |
| 1 | A | 90 | Re-heating | 400 | 2.91 | 4.0 | 0.9 | 788 | 346 | 100% | No | 80 | Disclosure Examples |
| 2 | B | 90 | Re-heating | 400 | 0.94 | 2.0 | 1.2 | 512 | 311 | 100% | No | 80 | Disclosure Examples |
| 3 | C | 90 | Re-heating | 400 | 1.37 | 2.0 | 0.8 | 1284 | 358 | 100% | No | 80 | Disclosure Examples |
| 4 | D | 90 | Re-heating | 400 | 6.00 | 8.0 | 1.4 | 859 | 326 | 100% | No | 80 | Disclosure Examples |
| 5 | E | 90 | Re-heating | 400 | 6.90 | 8.0 | 1.0 | 779 | 351 | 100% | No | 80 | Comparative Examples |
| 6 | F | 90 | Re-heating | 400 | 3.09 | 4.0 | 0.8 | 462 | 338 | 100% | No | 80 | Comparative Examples |
| 7 | G | 90 | Re-heating | 400 | 3.39 | 4.0 | 0.9 | 1411 | 374 | 100% | No | 80 | Disclosure Examples |
| 8 | H | 90 | Re-heating | 400 | 2.96 | 4.0 | 1.2 | 982 | 312 | 100% | No | 80 | Disclosure Examples |

TABLE 2-continued

| Production process | Alloy | Cooling rate after homogenization (° C./h) | Retention conditions at heating temperature before rolling: Heat history*1 | Temperature (° C.)*2 | Time (h) calculated by Equation A | Actual performance time (h) | Precipitate of ingot before hot rolling: Average particle diameter (μm) | Number (particles/100 μm²) | Hot-rolling winding temperature (° C.) | Recrystallization rate | Intermediate annealing | Cold rolling reduction (%) | Classification |
|---|---|---|---|---|---|---|---|---|---|---|---|---|---|
| 9 | I | 90 | Re-heating | 400 | 2.87 | 4.0 | 1.0 | 783 | 324 | 100% | No | 80 | Comparative Examples |
| 10 | J | 90 | Re-heating | 400 | 3.00 | 4.0 | 0.9 | 884 | 347 | 100% | No | 80 | Comparative Examples |
| 11 | K | 90 | Re-heating | 400 | 3.34 | 4.0 | 0.8 | 1366 | 359 | 100% | No | 80 | Disclosure Examples |
| 12 | L | 90 | Re-heating | 400 | 2.87 | 4.0 | 1.1 | 687 | 326 | 100% | No | 80 | Disclosure Examples |
| 13 | M | 90 | Re-heating | 400 | 2.91 | 4.0 | 1.0 | 769 | 341 | 100% | No | 80 | Comparative Examples |
| 14 | N | 90 | Re-heating | 400 | 0.09 | 0.3 | 1.1 | 813 | 321 | 100% | No | 80 | Disclosure Examples |
| 15 | O | 90 | Re-heating | 400 | 0.00 | 0.3 | 1.3 | 688 | 332 | 100% | No | 80 | Disclosure Examples |
| 16 | P | 90 | Re-heating | 400 | 0.34 | 0.5 | 0.9 | 549 | 363 | 100% | No | 80 | Disclosure Examples |
| 17 | Q | 90 | Re-heating | 400 | 0.51 | 2.0 | 1.0 | 744 | 357 | 100% | No | 80 | Disclosure Examples |
| 18 | R | 90 | Re-heating | 400 | 2.31 | 4.0 | 1.0 | 689 | 323 | 100% | No | 80 | Disclosure Examples |
| 19 | S | 90 | Re-heating | 400 | 2.70 | 4.0 | 1.1 | 901 | 362 | 100% | No | 80 | Disclosure Examples |
| 20 | T | 90 | Re-heating | 400 | 2.70 | 4.0 | 1.2 | 992 | 371 | 100% | No | 80 | Comparative Examples |
| 21 | U | 90 | Re-heating | 400 | 2.74 | 4.0 | 0.9 | 1013 | 361 | 100% | No | 80 | Disclosure Examples |
| 22 | V | 90 | Re-heating | 400 | 2.91 | 4.0 | 1.0 | 1097 | 378 | 100% | No | 80 | Comparative Examples |
| 23 | W | 90 | Re-heating | 400 | 3.00 | 4.0 | 1.2 | 863 | 356 | 100% | No | 80 | Disclosure Examples |
| 24 | X | 90 | Re-heating | 400 | 2.96 | 4.0 | 1.3 | 928 | 347 | 100% | No | 80 | Comparative Examples |
| 25 | A | 1800 | Direct re-tention | 440 | 3.91 | 4.0 | 1.3 | 402 | 339 | 100% | No | 70 | Disclosure Examples |
| 26 | A | 90 | Direct re-tention | 400 | 0.87 | 1.0 | 1.2 | 532 | 337 | 100% | No | 80 | Disclosure Examples |
| 27 | A | 30 | Direct re-tention | 370 | 0.50 | 1.0 | 1.0 | 746 | 351 | 100% | No | 70 | Disclosure Examples |
| 28 | A | 90 | Re-heating | 450 | 2.91 | 4.0 | 1.9 | 322 | 352 | 100% | No | 70 | Comparative Examples |
| 29 | A | 1800 | Re-heating | 440 | 13.03 | 15.0 | 1.4 | 681 | 341 | 100% | No | 80 | Disclosure Examples |
| 30 | A | 300 | Re-heating | 400 | 5.32 | 6.0 | 1.1 | 844 | 356 | 100% | No | 80 | Disclosure Examples |
| 31 | A | 90 | Re-heating | 370 | 2.91 | 4.0 | 0.7 | 1003 | 326 | 100% | No | 80 | Disclosure Examples |
| 32 | A | 90 | Re-heating | 360 | 2.91 | 4.0 | 0.3 | 2133 | 321 | 46% | No | 80 | Comparative Examples |
| 33 | A | 90 | Re-heating | 400 | 2.91 | 1.0 | 0.4 | 1724 | 339 | 18% | No | 70 | Comparative Examples |
| 34 | A | 90 | Re-heating | 400 | 2.91 | 4.0 | 0.9 | 788 | 388 | 100% | No | 70 | Comparative Examples |
| 35 | A | 90 | Re-heating | 400 | 2.91 | 4.0 | 0.9 | 788 | 305 | 54% | No | 70 | Comparative Examples |
| 36 | A | 90 | Re-heating | 400 | 2.91 | 4.0 | 0.9 | 788 | 268 | 0% | Batch annealing immediately after hot rolling | 70 | Comparative Examples |
| 37 | A | 90 | Re-heating | 400 | 2.91 | 4.0 | 0.9 | 788 | 291 | 0% | 30% cold rolling + batch annealing | 70 | Comparative Examples |
| 38 | A | 90 | Re-heating | 400 | 2.91 | 4.0 | 0.9 | 788 | 237 | 0% | 30% cold rolling + CAL | 70 | Comparative Examples |

TABLE 2-continued

| Production process | Alloy | Cooling rate after homogenization (° C./h) | Retention conditions at heating temperature before rolling: Heat history*1 | Temperature (° C.)*2 | Time (h) calculated by Equation A | Actual performance time (h) | Precipitate of ingot before hot rolling: Average particle diameter (μm) | Number (particles/100 μm²) | Hot-rolling winding temperature (° C.) | Recrystallization rate | Intermediate annealing | Cold rolling reduction (%) | Classification |
|---|---|---|---|---|---|---|---|---|---|---|---|---|---|
| 39 | N | 1800 | Direct retention | 400 | 0.11 | 0.12 | 0.5 | 493 | 334 | 88% | No | 80 | Comparative Examples |
| 40 | N | 1800 | Direct retention | 400 | 0.11 | 0.2 | 0.6 | 402 | 336 | 100% | No | 80 | Disclosure Examples |

*1"Heat history" means a heat history from cooling after homogenization treatment to retention at a heating temperature before rolling.
"Direct retention": An ingot was cooled to a heating temperature before rolling so as to be prevented from being cooled to 320° C. or less, and was retained.
"Re-heating": An ingot was cooled to room temperature, then re-heated, and retained at a heating temperature before rolling.
*2Heating temperature before rolling, which was set at the same temperature as a hot-rolling temperature in the present embodiment.

(ii) Mechanical Properties of Aluminum Alloy Rolled Material, and Measurement and Evaluation of Texture For each aluminum alloy sheet material produced in the present examples, a JIS No. 5 test piece was first cut in a direction parallel to a rolling direction, and the tensile strength (ASTS) and 0.2% proof stress (ASYS) of the test piece were measured by a tensile test.

The states (cube orientation density, and dispersion of average Taylor factors) of the texture of a predetermined plane of each sheet material were measured. For the cube orientation density, a plane S2 at a depth of ¼ of a total sheet thickness was exposed by mechanical polishing and subjected to X-ray diffraction measurement, the orientation information of the texture was acquired by measuring the incomplete pole figures of a (111) plane, a (220) plane, and a (200) plane, and the cube orientation density was calculated using pole figure analysis software, as described above.

Further, a plane S3 at a depth of ½ of the total sheet thickness was exposed by mechanical polishing, and SEM-EBSD measurement of the exposed plane was performed by the above-described method, as described above. A region SA was set in the center in a sheet width direction as a representative example of an arbitrary region in the S3 plane, and the orientation information of the textures of corresponding divided regions SA1, SA2, . . . , SA10 in the region SA was then acquired. Average Taylor factors were calculated from the obtained orientation information by the above-described method, and the absolute value of the difference between the maximum and minimum values of the average Taylor factors between the corresponding divided regions in the same plane was calculated.

(iii) Evaluation of Bendability and Ridging Resistance of Aluminum Alloy Rolled Sheet Material The workability and ridging resistance of each aluminum alloy sheet material produced by the present examples were evaluated to examine production conditions and the relationships of the configuration of the alloy sheet material, workability, and the like. First, the ridging resistance was evaluated using a conventionally performed simple evaluation technique. Specifically, JIS No. 5 test pieces were collected along a direction at 90° with respect to a rolling direction and subjected to 10% and 15% stretches, respectively. Assuming that a stripe pattern (stripe-shaped recessed and projected pattern) generated on a surface along the rolling direction was regarded as a ridging mark, the presence or absence and degree of generation of the stripe pattern were determined by visual observation. The results are shown in Table 3. In Table 3, "Excellent" shows the absence of a stripe pattern, "Good" shows a state in which a slight stripe pattern was visually observed, "Fair" shows a moderate stripe pattern, and "Poor" shows a state in which a stripe pattern was vivid. In the present embodiment, it was determined that "Excellent" or "Good" showed that ridging resistance was favorable.

Figure 2:
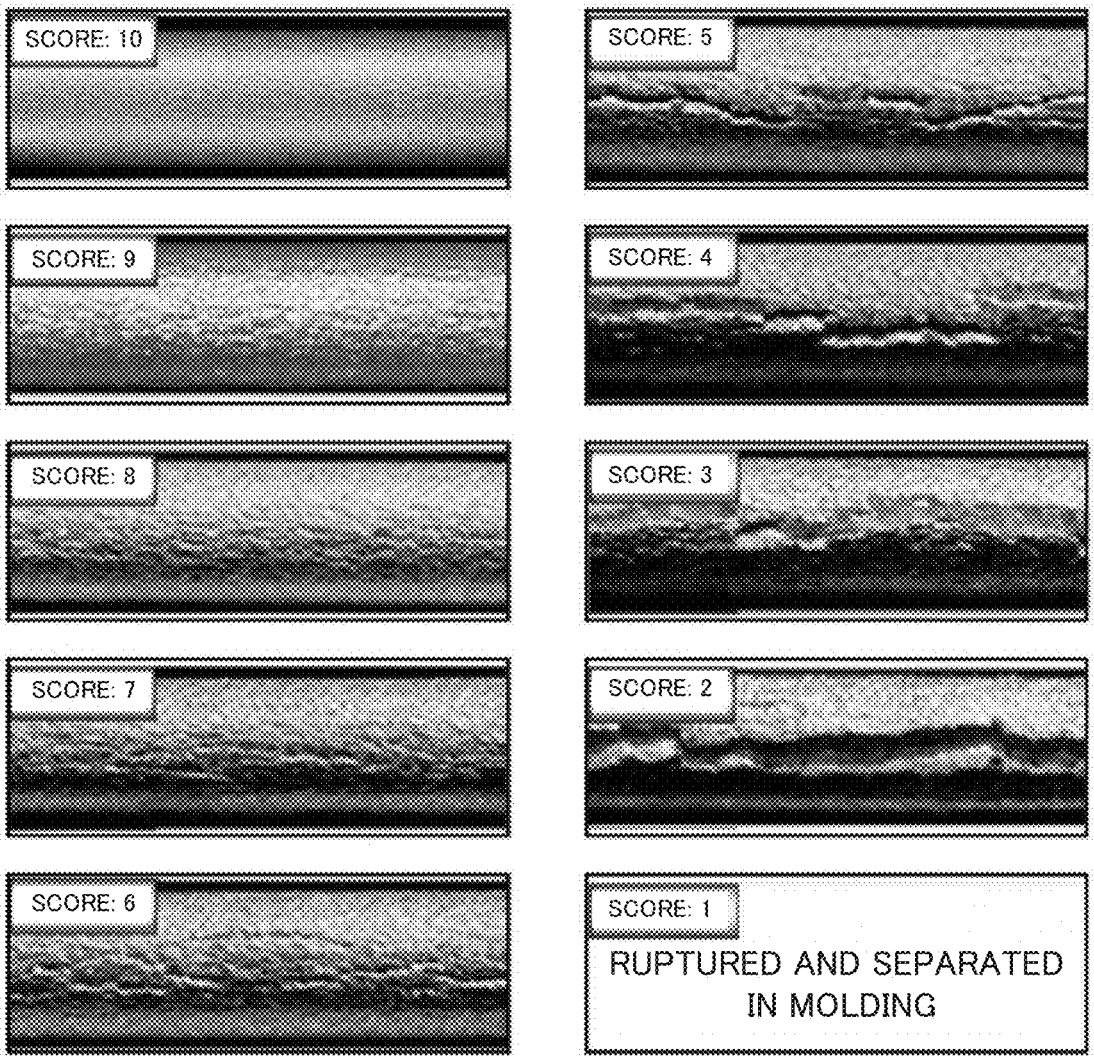
FIG. 2 is a view illustrating the appearances of samples for evaluation of bending test results in an embodiment of the present application.

In addition, bending workability was evaluated by a 180° bending test. Bending test pieces were collected along a direction at 90° with respect to the rolling direction and subjected to 5% predistortion. Then, the 180° bending test of the bending test pieces between which an intermediate plate having a thickness of 1 mm (bend radius: 0.5 mm) was interposed was conducted. The bending workability of the appearance of the bend in each direction was given a point (score) in comparison with the bending workability evaluation samples illustrated in FIG. 2. The results are shown in Table 3. The higher numerical value of the score in the bending test represents more favorable bending workability. In the present embodiment, it was determined that a point of "6" or more showed favorable bending workability.

The mechanical properties (tensile strength and 0.2% proof stress), measurement and evaluation results of textures, and results of evaluation test of bending workability and ridging resistance of the aluminum alloy rolled sheets produced in the present examples are shown in Table 3.

TABLE 3

| Production process | Alloy | States of texture: Cube orientation density | Dispersion of Taylor factors | Evaluation of ridging resistance: After 10% stretch | After 15% stretch | Bending test score | Tensile test results: ASYS (MPa) | ASTS (MPa) | ASTS − ASYS (MPa) | Classification |
|---|---|---|---|---|---|---|---|---|---|---|
| 1 | A | 12 | 0.7 | Excellent | Excellent | 8 | 116 | 245 | 129 | Disclosure Examples |
| 2 | B | 26 | 0.6 | Excellent | Excellent | 9 | 105 | 219 | 114 | Disclosure Examples |

TABLE 3-continued

| | | States of texture | | Evaluation of ridging resistance | | | Tensile test results | | | |
|---|---|---|---|---|---|---|---|---|---|---|
| Production process | Alloy | Cube orientation density | Dispersion of Taylor factors | After 10% stretch | After 15% stretch | Bending test score | ASYS (MPa) | ASTS (MPa) | ASTS − ASYS (MPa) | Classification |
| 3 | C | 18 | 0.8 | Excellent | Excellent | 8 | 108 | 229 | 121 | Disclosure Examples |
| 4 | D | 10 | 0.7 | Excellent | Excellent | 7 | 140 | 269 | 129 | Disclosure Examples |
| 5 | E | 13 | 0.6 | Excellent | Excellent | 5 | 142 | 268 | 126 | Comparative Examples |
| 6 | F | 21 | 0.7 | Excellent | Excellent | 8 | 101 | 199 | 98 | Comparative Examples |
| 7 | G | 12 | 0.7 | Excellent | Excellent | 8 | 110 | 233 | 123 | Disclosure Examples |
| 8 | H | 15 | 0.6 | Excellent | Excellent | 7 | 138 | 261 | 123 | Disclosure Examples |
| 9 | I | 13 | 0.7 | Excellent | Excellent | 5 | 139 | 266 | 127 | Comparative Examples |
| 10 | J | 20 | 0.7 | Excellent | Excellent | 8 | 100 | 197 | 97 | Comparative Examples |
| 11 | K | 16 | 0.7 | Excellent | Excellent | 8 | 103 | 225 | 122 | Disclosure Examples |
| 12 | L | 12 | 0.7 | Excellent | Excellent | 7 | 138 | 269 | 131 | Disclosure Examples |
| 13 | M | 11 | 0.7 | Excellent | Excellent | 5 | 140 | 268 | 128 | Comparative Examples |
| 14 | N | 38 | 0.5 | Excellent | Excellent | 10 | 110 | 216 | 106 | Disclosure Examples |
| 15 | O | 36 | 1.0 | Good | Good | 9 | 113 | 221 | 108 | Disclosure Examples |
| 16 | P | 27 | 1.0 | Good | Good | 10 | 101 | 203 | 102 | Disclosure Examples |
| 17 | Q | 24 | 0.6 | Good | Good | 6 | 121 | 233 | 112 | Disclosure Examples |
| 18 | R | 13 | 0.8 | Excellent | Excellent | 6 | 106 | 228 | 122 | Disclosure Examples |
| 19 | S | 11 | 1.0 | Good | Good | 7 | 110 | 231 | 121 | Disclosure Examples |
| 20 | T | 11 | 1.0 | Good | Good | 5 | 112 | 234 | 122 | Comparative Examples |
| 21 | U | 13 | 1.0 | Good | Good | 7 | 109 | 232 | 123 | Disclosure Examples |
| 22 | V | 12 | 1.0 | Good | Good | 5 | 113 | 237 | 124 | Comparative Examples |
| 23 | W | 14 | 0.7 | Excellent | Excellent | 6 | 111 | 233 | 122 | Disclosure Examples |
| 24 | X | 10 | 0.6 | Excellent | Excellent | 5 | 112 | 236 | 124 | Comparative Examples |
| 25 | A | 15 | 0.5 | Excellent | Excellent | 9 | 110 | 241 | 131 | Disclosure Examples |
| 26 | A | 15 | 0.6 | Excellent | Excellent | 8 | 115 | 243 | 128 | Disclosure Examples |
| 27 | A | 15 | 0.7 | Excellent | Excellent | 8 | 112 | 239 | 127 | Disclosure Examples |
| 28 | A | 11 | 1.2 | Fair | Fair | 8 | 109 | 233 | 124 | Comparative Examples |
| 29 | A | 13 | 0.7 | Excellent | Excellent | 8 | 120 | 252 | 132 | Disclosure Examples |
| 30 | A | 12 | 0.6 | Excellent | Excellent | 9 | 121 | 254 | 133 | Disclosure Examples |
| 31 | A | 12 | 0.8 | Excellent | Excellent | 8 | 119 | 249 | 130 | Disclosure Examples |
| 32 | A | 12 | 1.6 | Poor | Poor | 9 | 121 | 247 | 126 | Comparative Examples |
| 33 | A | 20 | 1.6 | Poor | Poor | 9 | 122 | 249 | 127 | Comparative Examples |
| 34 | A | 18 | 1.5 | Fair | Fair | 9 | 115 | 245 | 130 | Comparative Examples |
| 35 | A | 20 | 1.6 | Poor | Poor | 9 | 116 | 246 | 130 | Comparative Examples |
| 36 | A | 23 | 1.8 | Poor | Poor | 9 | 113 | 237 | 124 | Comparative Examples |
| 37 | A | 21 | 1.6 | Fair | Fair | 8 | 112 | 235 | 123 | Comparative Examples |
| 38 | A | 4 | 0.1 | Excellent | Excellent | 5 | 129 | 252 | 123 | Comparative Examples |

TABLE 3-continued

| Production process | Alloy | States of texture: Cube orientation density | States of texture: Dispersion of Taylor factors | Evaluation of ridging resistance: After 10% stretch | Evaluation of ridging resistance: After 15% stretch | Bending test score | Tensile test results: ASYS (MPa) | Tensile test results: ASTS (MPa) | Tensile test results: ASTS − ASYS (MPa) | Classification |
|---|---|---|---|---|---|---|---|---|---|---|
| 39 | N | 30 | 1.1 | Fair | Fair | 9 | 112 | 224 | 112 | Comparative Examples |
| 40 | N | 34 | 0.9 | Excellent | Good | 9 | 111 | 223 | 112 | Disclosure Examples |

In the present disclosure, the constituent compositions of all of the aluminum alloy sheet material of the production processes No. 1 to No. 4, No. 7, No. 8, No. 11, No. 12, No. 14 to No. 19, No. 21, No. 23, No. 25 to No. 27, No. 29 to No. 31, and No. 40 which are the disclosure examples of the present disclosure are within the ranges defined in present disclosure. In the production processes, conditions within the ranges defined in the present disclosure are applied for various conditions. The aluminum alloy sheets were confirmed to have favorable ridging resistance and bending workability. A tensile strength of 200 MPa or more was achieved, and the material strength was favorable. A difference between the tensile strength (ASTS) and a 0.2% proof stress (ASYS) is more than 100 MPa, and a condition for a common Al—Mg—Si-based alloy for an automobile panel is achieved. The aluminum alloy sheets which are the disclosure examples have a cube orientation density in a plane S2 and the dispersion of average Taylor factors in a plane S3 which are within preferred ranges, respectively.

In contrast, the contents of Si and Mg which are essential constituent elements in the aluminum alloy sheets of the production processes No. 6 and No. 10 are less than the ranges defined in the present disclosure. The results of the aluminum alloy sheet material comprising an alloy F (No. 6) having a Si content of less than 0.30% and an alloy J (No. 10) having a Mg content of less than 0.30% are shown. The aluminum alloy sheets are incapable of having sufficient strength because the contents of Si and Mg in the aluminum alloy sheets are not more than the ranges defined in present disclosure. Therefore, the Comparative Examples did not achieve the conditions for a common Al—Mg—Si-based alloy for an automobile panel, of a tensile strength of 200 MPa or more and a difference between the tensile strength (ASTS) and a 0.2% proof stress (ASYS) of 100 MPa or more.

The contents of Si and Mg which are essential constituent elements in the aluminum alloy sheets of the production processes No. 9 and No. 13 are more than the ranges defined in the present disclosure. The results of the aluminum alloy sheets comprising an alloy I (No. 9) having a Si content of more than 1.50% and an alloy M (No. 13) having a Mg content of more than 1.50% are shown. Because the contents of Si and Mg in the aluminum alloy sheet material are more than the ranges defined in the present disclosure, coarse particles formed in the production steps also remain in the product sheets and become the origins of cracks in bending, and therefore, the aluminum alloy sheets do not have sufficient bending workability. Therefore, scores in the bending test were low in the Comparative Examples.

The content of Cu in the aluminum alloy sheet of the production process No. 5 is more than the upper limit value (1.50%) of the preferred range. In the bending test, the aluminum alloy sheet of No. 5 had a low score, which was a result in which it was necessary to regard the aluminum alloy sheet as a comparative example.

The contents of Mn, Cr, and Fe in the aluminum alloy sheets of the production processes Nos. 20, 22, and 24 are more than the preferred ranges. In the bending test, the aluminum alloy sheets had low scores, which were results in which it was necessary to regard the aluminum alloy sheets as Comparative Examples.

Although the ridging resistance and bending workability of the aluminum alloy sheet of the production process No. 18 were acceptable, the contents of Fe, Mn, and Cr in the aluminum alloy sheet were less than the preferred lower limits (Mn: 0.03% or less, Cr: 0.01 or less, and Fe: 0.03 or less). Therefore, slight surface roughening which can be considered to be caused by coarsening of crystal grains in solution treatment occurred in the aluminum alloy sheet. Thus, the workability of the alloy may be considered to be acceptable to some extent, but the alloy can be considered not to be recommended when importance is particularly placed on working quality.

In the present examples, aluminum alloy sheets in which the contents of Cu are less than 0.10% (alloy N, alloy O, and alloy P) are produced so as to have heat histories ("direct retention" or "re-heating") and cooling rates (90° C. and 1800° C.) set at plural conditions (production processes No. 14 to No. 16, and No. 40). The examples reveal that with regard to an alloy having a low Cu content, an aluminum alloy sheet with satisfactory mechanical properties as well as favorable ridging resistance and excellent bendability can be produced by setting the appropriate production conditions. It was confirmed that an aluminum alloy sheet, such as the alloy O, having a very low Cu content which is the lower limit in the present disclosure also exhibits favorable characteristics due to the appropriate production conditions (production process No. 15).

Although the aluminum alloy sheets of the production processes No. 28 and No. 32 to No. 39 have constituent compositions within the ranges defined in the present disclosure, any of the production process conditions in the aluminum alloy sheets deviate from the ranges defined in the present disclosure. As a result, the aluminum alloy sheets are poor in ridging resistance and bending workability.

These Comparative Examples will be specifically described. First, Table 2 reveals that the temperature at which hot rolling is started in the production process No. 32 is lower than the condition defined in the present disclosure. In this comparative example, retention was performed at the heating temperature before rolling for not less than the lower limit of a retention time calculated by Equation A before hot rolling, but any precipitate having a size sufficient for promoting self-annealing was not able to be obtained, and recrystallization after the hot rolling did not sufficiently proceed. In the production process No. 33, the retention time at the heating temperature before rolling was shorter than the lower limit of a retention time calculated by Equation A. Therefore, a large number of fine precipitates were formed. As a result, the recrystallization after the hot rolling did not sufficiently proceed. Further, in the production process No. 35, the temperature at which a hot-rolled sheet after hot rolling was wound was less than 310° C., and therefore, recrystallization due to self-annealing did not proceed.

Further, in the production process No. 39, the retention time at a heating temperature before rolling was set at not less than the lower limit of a retention time calculated by Equation A but less than 0.17 hours. As a result, a large number of fine precipitates were formed. As a result, recrystallization after hot rolling did not sufficiently proceed.

The aluminum alloy sheets of the production processes No. 32, No. 33, No. 35, and No. 39 are aluminum alloy sheets with insufficient recrystallization in states after hot-rolling winding. Table 3 reveals that the aluminum alloy sheets were poor in ridging resistance. In the aluminum alloy sheets, the differences between the maximum and minimum values of the average Taylor factors of the planes S3 were more than 1.0.

The aluminum alloy sheet in the production process No. 28 was produced at a hot-rolling starting temperature set at more than 440° C., and the aluminum alloy sheet in the production process No. 34 was produced at a winding temperature after hot rolling of more than 380° C. The textures of the aluminum alloy sheets were insufficient controlled, and the aluminum alloy sheets were poor in ridging resistance. In the aluminum alloy sheets, the differences between the maximum and minimum values of the average Taylor factors of the planes S3 of the final sheets were also more than 1.0.

The production processes No. 36 to No. 38 are production examples in which intermediate annealing was performed after hot rolling while setting a temperature at which a hot-rolled sheet after the hot rolling was wound at less than 310° C. These results reveal that it is particularly important to manage cooling after homogenization treatment, retention at a heating temperature before rolling, and a temperature at which a hot-rolled sheet after hot rolling is wound, for improving bending workability and ridging resistance in a good balance. In addition, it is found that when treatment outside the conditions defined by the present disclosure is performed in these processes, it is difficult to attain an objective, and intermediate annealing is also ineffective. The low effect of the intermediate annealing is understood from poor ridging resistance in intermediate annealing (batch annealing) after hot rolling like No. 36. Like No. 37, even when cold rolling (30%) was performed before intermediate annealing (batch annealing), only ridging resistance was improved. In No. 38, intermediate annealing was performed in a continuous annealing furnace, and bending workability was deteriorated although ridging resistance was improved. As described above, the performance of intermediate annealing enables a texture to be changed depending on the conditions of the intermediate annealing, but the insufficient management of a heat history from cooling to hot rolling after homogenization treatment precludes bending workability and ridging resistance from being simultaneously in preferred ranges. In the aluminum alloy sheets of No. 36 and No. 37, the differences between the maximum and minimum values of the average Taylor factors of the planes S3 were more than 1.0. In contrast, in the aluminum alloy sheet of No. 38, the difference between the maximum and minimum values of the average Taylor factors of the plane S3 was less than 1.0, but the ratio of the cube orientation density with respect to the random orientation of the plane S2 was less than 10.

INDUSTRIAL APPLICABILITY

In accordance with the method for producing an aluminum alloy rolled material according to the present disclosure, an aluminum alloy rolled material with compatibility between ridging resistance and bending workability can be efficiently produced, as described above. The present disclosure can be utilized for producing an aluminum alloy rolled material which becomes the materials of molded components such as the panels and chassis of electronic and electrical instruments and the like as well as automotive applications such as automotive body sheets applied to the body panels of automobiles.

The invention claimed is:

1. A method for producing an aluminum alloy rolled material for deformation molding, the method comprising:

a step of performing homogenization treatment of an ingot comprising an aluminum alloy comprising Si: 0.30 to 1.50 mass %, Mg: 0.30 to 1.50 mass %, Cu: 0.001 to 1.50 mass %, at least any of 0.50 mass % or less of Mn, 0.40 mass % or less of Cr, and 0.40 mass % or less of Fe, and a balance of Al and inevitable impurities;

a cooling step of cooling the aluminum alloy after the homogenization treatment in a single cooling process from a temperature at the homogenization treatment to an end temperature higher than 320° C., wherein an average cooling rate from 500° C. to the end temperature in ¼ part from a surface of the ingot of a total thickness is 150° C./h to 2000° C./h;

a step of starting hot rolling at 370° C. to 440° C. and winding the hot-rolled aluminum alloy at 310 to 380° C., and a step of cold-rolling the aluminum alloy after the hot rolling at a total cold rolling reduction of 65% or more, wherein the method for producing an aluminum alloy rolled material for deformation molding further comprises a step of retaining the aluminum alloy after the cooling step for 0.17 hours or more at a heating temperature before rolling set within a range of 370° C. to 440° C. before the hot rolling, and wherein cold-rolling is performed without intermediate annealing in the step of cold-rolling.

2. The method for producing an aluminum alloy rolled material for deformation molding according to claim 1, wherein the aluminum alloy after the cooling step is retained at the heating temperature before rolling for not less than a lower limit of a retention time calculated by Equation A described below $$\text{lower limit of retention time (h)} = 3\ \text{(h)} \times \text{Cu amount coefficient} \times \text{cooling rate coefficient} \times \text{temperature history coefficient} \quad \text{(Equation A)}$$

wherein the lower limit of a retention time is set at 0.17 hours when the lower limit of a retention time in Equation A is less than 0.17 hours; and meanings of the Cu amount coefficient, the cooling rate coefficient, and the temperature history coefficient in Equation A are described as follows:

Cu amount coefficient: Cu content (mass %) in aluminum alloy/reference Cu content (0.7 mass %);

cooling rate coefficient: (average cooling rate (° C./h) in cooling step/reference cooling rate (90° C./h))$^{1/2}$; and temperature history coefficient: set at 0.3.

3. The method for producing an aluminum alloy rolled material for deformation molding according to claim 1, further comprising: a step of solution treatment of the aluminum alloy after the cold-rolling step.

4. The method for producing an aluminum alloy rolled material for deformation molding according to claim 1, wherein the aluminum alloy comprises at least any of Mn: 0.03 to 0.50 mass %, Cr: 0.01 to 0.40 mass %, and Fe: 0.03 to 0.40 mass %.

5. A method for producing an aluminum alloy rolled material for deformation molding, the method comprising:

a step of performing homogenization treatment of an ingot comprising an aluminum alloy comprising Si: 0.30 to 1.50 mass %, Mg: 0.30 to 1.50 mass %, Cu: 0.001 to 1.50 mass %, at least any of 0.50 mass % or less of Mn, 0.40 mass % or less of Cr, and 0.40 mass % or less of Fe, and a balance of Al and inevitable impurities;

a cooling step of cooling the aluminum alloy after the homogenization treatment in a single cooling process from a temperature at the homogenization treatment to an end temperature that is less than or equal to 320° C., wherein an average cooling rate from 500° C. to 320° C. in ¼ part from a surface of the ingot of a total thickness is 150° C./h to 2000° C./h;

a step of starting hot rolling at 370° C. to 440° C. and winding the hot-rolled aluminum alloy at 310 to 380° C., and a step of cold-rolling the aluminum alloy after the hot rolling at a total cold rolling reduction of 65% or more, wherein the method for producing an aluminum alloy rolled material for deformation molding further comprises a step of retaining the aluminum alloy after the cooling step for 0.17 hours or more at a heating temperature before rolling set within a range of 370° C. to 440° C. before the hot rolling, and wherein cold-rolling is performed without intermediate annealing in the step of cold-rolling.

6. The method for producing an aluminum alloy rolled material for deformation molding according to claim 5, wherein the aluminum alloy after the cooling step is retained at the heating temperature before rolling for not less than a lower limit of a retention time calculated by Equation A described below:

$$\text{lower limit of retention time (h)} = 3\ (\text{h}) \times \text{Cu amount coefficient} \times \text{cooling rate coefficient} \times \text{temperature history coefficient} \quad \text{(Equation A)}$$

wherein the lower limit of a retention time is set at 0.17 hours when the lower limit of a retention time in Equation A is less than 0.17 hours; and meanings of the Cu amount coefficient, the cooling rate coefficient, and the temperature history coefficient in Equation A are described as follows:

Cu amount coefficient: Cu content (mass %) in aluminum alloy/reference Cu content (0.7 mass %);

cooling rate coefficient: (average cooling rate (° C./h) in cooling step/reference cooling rate (90° C./h))$^{1/2}$; and temperature history coefficient: set at 1.0.

7. The method for producing an aluminum alloy rolled material for deformation molding according to claim 5, further comprising: a step of solution treatment of the aluminum alloy after the cold-rolling step.

8. The method for producing an aluminum alloy rolled material for deformation molding according to claim 5, wherein the aluminum alloy comprises at least any of Mn: 0.03 to 0.50 mass %, Cr: 0.01 to 0.40 mass %, and Fe: 0.03 to 0.40 mass %.

* * * * *